US006483465B2

(12) United States Patent
Itoh et al.

(10) Patent No.: US 6,483,465 B2
(45) Date of Patent: Nov. 19, 2002

(54) CIRCULARLY POLARIZED WAVE ANTENNA AND MANUFACTURING METHOD THEREFOR

(75) Inventors: Shigekazu Itoh, Ishikawa-gun (JP); Kazunari Kawahata, Machida (JP); Atsuyuki Yuasa, Sagamihara (JP); Hisashi Akiyama, Yokohama (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/954,658

(22) Filed: Sep. 18, 2001

(65) Prior Publication Data

US 2002/0036590 A1 Mar. 28, 2002

(30) Foreign Application Priority Data

Sep. 25, 2000 (JP) ..... 2000-290262

(51) Int. Cl.[7] ..... H01Q 1/38
(52) U.S. Cl. ..... 343/700 MS; 343/702
(58) Field of Search ..... 343/700 MS, 702, 343/846, 848; 455/90; H01Q 1/24, 1/38

(56) References Cited

U.S. PATENT DOCUMENTS 5,945,959 A * 8/1999 Tanidokoro et al. . 343/700 MS
6,040,806 A * 3/2000 Kushihi et al. ..... 343/700 MS
6,140,968 A * 10/2000 Kawahata et al. ... 343/700 MS
6,262,683 B1 * 7/2001 Kawahata et al. ... 343/700 MS
6,281,848 B1 * 8/2001 Nagumo et al. ..... 373/700 MS
6,392,602 B2 * 5/2002 Kawahata et al. ... 343/700 MS
6,396,442 B1 * 5/2002 Kawahata et al. ... 343/700 MS

FOREIGN PATENT DOCUMENTS

JP 7-46762 8/1987

* cited by examiner

*Primary Examiner*—Tan Ho
(74) *Attorney, Agent, or Firm*—Ostrolenk, Faber, Gerb & Soffen, LLP

(57) ABSTRACT

A circularly polarized wave antenna which allows the matching of resonant frequencies in a higher order mode to be easily achieved. In this circularly polarized wave antenna, a flat portion is provided by flattening a portion of the peripheral side surface of a substrate. Two feeding electrodes for use in the higher order mode excitation are formed on this flat plane. On one main surface of the substrate, a circular radiation electrode is formed, while, on the other main surface of the substrate, a ground electrode is formed.

19 Claims, 5 Drawing Sheets

CIRCULARLY POLARIZED WAVE ANTENNA AND MANUFACTURING METHOD THEREFOR

BACKGROUND OF THE INVENTION

1. Field of the Invention

The present invention relates to a circularly polarized wave antenna, and particularly, to a circularly polarized wave antenna excited in a higher order mode such as in a DAB (Digital Audio Broadcast) system, and to a manufacturing method therefor.

2. Description of the Related Art

As an antenna excited in a higher order mode, one which is disclosed in Japanese Examined Patent Application Publication No. 07-46762 is known. As shown in FIGS. 10 and 11, this antenna has a two-layer structure wherein a microstrip antenna 2 for use in the major mode excitation is placed on a microstrip antenna 1 for use in the higher order mode excitation.

Specifically, in the microstrip antenna 1 for use in the higher order mode excitation, a dielectric substrate 3 having a square shape in a plan view is used, a plan-view circular radiation electrode 4 for use in the higher order mode excitation is formed on the front surface of the substrate, and a ground electrode 5 is provided over the entire back surface of the substrate 3. On the other hand, in the microstrip antenna 2 for use in the major mode excitation, a disk shaped substrate 6 is used, and a radiation electrode 7 for use in the major mode excitation is formed over the entire circular surface of the substrate 6, as well as a center pin 8 is disposed along the center axis of the radiation electrode 4 for use in the higher order mode excitation and the radiation electrode 7 for use in the major mode excitation, thereby ensuring the symmetry between the major mode and the higher order mode.

In the microstrip antenna 2 for use in the major mode excitation, probes F1 and F2 for use in the major mode excitation are disposed at the angular positions of 90° with respect to the center pin 8, on the surface of the radiation electrode 7. These probes are provided so as to pass through the substrates 3 and 6 without contacting the radiation electrode 4 for use in the higher order mode excitation and the ground electrode 5.

Also, in the microstrip antenna 1 for use in the higher order mode excitation, probes G10, G11, G20, and G21 for use in the higher order mode excitation are disposed on the 0° and 45° lines passing through the center pin 8, on the surface of the radiation electrode 4. Specifically, a pair of probes G10 and G11 for use in the first order mode excitation are disposed at the positions symmetrical with each other around the center pin 8 on the line connecting the center pin 8 and the probe F1, and a pair of probes G20 and G21 are disposed at the positions on the 45° line which divides the angle formed by the probes F1 and F2 into equal halves. The probes G10, G11, G20, and G21 are provided so as to pass through the substrate 3 without contacting the ground electrode 5.

In the above-described features, when signal powers for the major mode excitation are supplied to the probes F1 and F2 for use in the major mode excitation, with a phase difference of 90° provided therebetween using a 90° hybrid or the like, a circularly polarized wave is generated. On the other hand, when in-phase signal powers for the higher order mode excitation are each supplied to the probes G10 and G11, and the probes G20 and G21 for use in the higher order mode excitation, and signal powers which have a mutual phase difference of 90° are supplied to the probes G10 and G11, and the probes G20 and G21 for use in the higher order mode excitation, a circularly polarized wave in the second order mode (TM21 mode) is generated.

In the microstrip antenna 1 for use in the higher order mode excitation which has the above-described features, since four probes G10, Gil, G20, and G21 for use in the higher order mode excitation are disposed so as to pass through the dielectric substrate 3, the interference (intercoupling) between the radiation electrode 4 for use in the higher order mode excitation and each of the probes G10, G11, G20, and G21 easily occurs, so that there may be a case where the matching between resonant frequencies cannot be achieved.

Also, since the dielectric substrate 3 has a square shape in a plan view, the distances between the periphery of the plan-view circular radiation electrode 4 and the edge line of the substrate 3 are mutually different between the two directions of higher order mode excitation, so that the mutual difference in edge effect, in other words, the mutual difference in the capacitance between the periphery of the radiation electrode 4 and the ground electrode occurs between the two directions. Particularly when the dielectric constant of the substrate 3 is high, this difference becomes significant. The difference in the edge effect would cause a difference in the frequency characteristic of linearly polarized waves between the two directions of the higher order mode excitation. This causes a problem in that circularly polarized waves in a higher order mode reduce the bandwidth in the axial ratio-frequency characteristic.

SUMMARY OF THE INVENTION

The present invention has been achieved to solve the above-described problems, and an object thereof is to provide a circularly polarized wave antenna which allows a superior higher order mode excitation to be achieved, and to provide a manufacturing method for the same which allows various electrodes to be easily formed.

In order to achieve the above-described object, the present invention uses the following configurations to solve the above-described problems. The circularly polarized wave antenna in accordance with the present invention comprises a substantially cylindrical substrate comprising a dielectric body; a radiation electrode having a circular shape in a plan view, the radiation electrode being formed on one main surface of the substrate; a ground electrode formed on the other main surface of the substrate; a flat portion formed by flattening a portion of the peripheral side surface of the substrate; and at least two strip shaped feeding electrodes which are formed on the flat portion so as to extend from the ground electrode side to the radiation electrode side.

In the circularly polarized wave antenna with the above-described features, the main surface of the substrate comprises a perfect circle, and the radiation electrode is formed so as to have a diameter smaller than that of the main surface of the substrate so as to be effective diameter to excite the TMn1 ($n \geqq 2$, n: natural number) mode which is a higher order mode. The radiation electrode is disposed coaxially with the main surface of the substrate, and the flat portion provided on the substrate is formed as a flat plane parallel to an imaginary plane (hereinafter, referred to the "axial plane") passing the center axis of the substrate.

The two feeding electrodes are disposed so as to form an angle of 90/n° ($n \geqq 2$, n: natural number) with respect to the center axis of the substrate, and disposed at the positions which form a plane-symmetry with another axial plane perpendicular to the flat plane. When a signal power is supplied to each of the feeding electrodes, two linearly polarized waves which spatially form 90/n°, are excited, and by making a phase difference of 90° between the two signal powers, a circularly polarized wave in a higher order mode is radiated.

In the circularly polarized wave antenna in accordance with the present invention, it is preferable that the flat portion be provided with a second electrode in conjunction with the feeding electrodes.

In the present invention, since the two feeding electrodes are disposed at angular positions forming 90/n° with respect to the center axis of the substrate, the space between the two feeding electrodes remains blank. A second electrode, therefore, is provided making use of the blank between the two feeding electrodes.

The manufacturing method for a circularly polarized wave antenna in accordance with the present invention comprises the steps of forming a radiation electrode having a circular shape in a plan view, on one main surface of a cylindrical substrate, and forming a ground electrode on the other main surface thereof; flattening a portion of the peripheral side surface of the substrate; and collectively forming at least a plurality of feeding electrodes on the flat portion so as to extend from the ground electrode side to the radiation electrode side.

In the manufacturing method for a circularly polarized wave antenna in according with the present invention, since a portion of the peripheral side surface of the substrate is formed into a flat plane, a screen pattern on which electrode patterns are formed, can be placed on the flat plane of the substrate, parallel to the flat plane when printing feeding electrodes using the thick-film screen printing technique. This allows a plurality of feeding electrodes to be collectively formed by printing them at one time.

In addition, in the manufacturing method for a circularly polarized wave antenna in accordance with the present invention, the above-described flat peripheral side surface is formed as a plane parallel to the center axis of the substrate.

In accordance with the present invention, the two main surfaces of the substrate have the same shape, and the width of the flat portion is the same at any position along the center axis direction.

The above and other objects, features, and advantages of the present invention will be clear from the following detailed description of the preferred embodiments of the invention in conjunction with the accompanying drawings.

BRIEF DESCRIPTION OF THE DRAWING(S)

FIGS. 1A and 1B are perspective views showing a configuration of a circularly polarized wave antenna in accordance with the present invention, wherein FIG. 1A is a view seen from the top surface side, and FIG. 1B is a view seen from the bottom surface side;

DETAILED DESCRIPTION OF EMBODIMENTS OF THE INVENTION

Figure 1A:
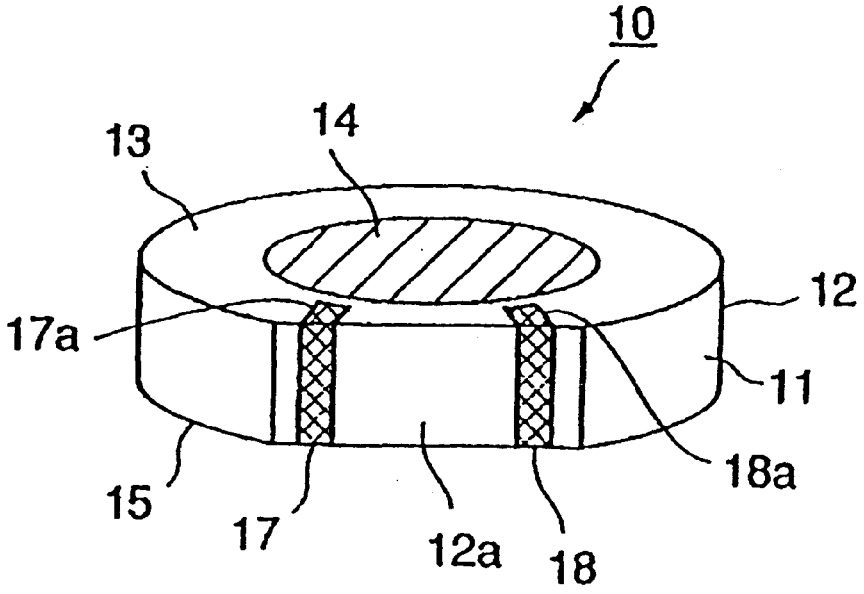
Figure 1B:
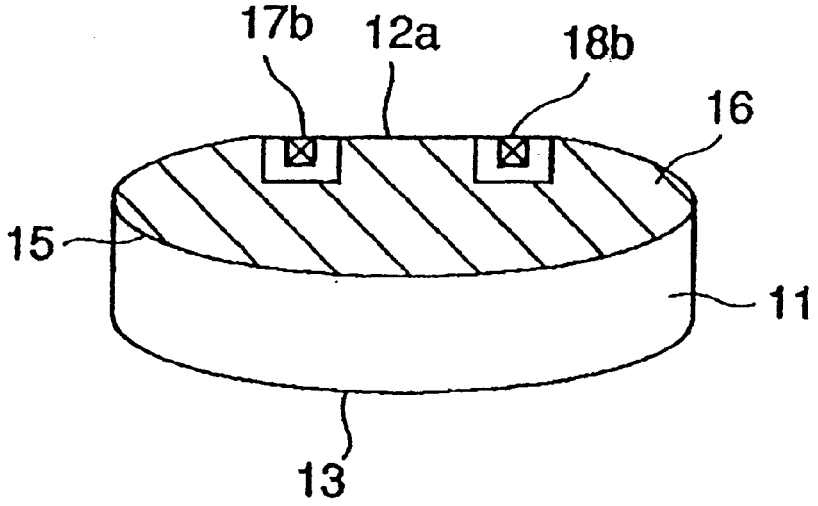

FIGS. 1A and 1B show a circularly polarized wave antenna in a higher order mode. The circularly polarized wave antenna 10 has a substantially cylindrical substrate 11 formed of a dielectric body. The peripheral side surface 12 of the substrate 11 is configured so that one portion thereof becomes a flat plane 12*a* parallel to the axial plane passing through the center axis of the substrate 11. The center axis of the substrate 11 is the one when one main surface 13 of the substrate 11 is assumed to be a perfect circle. On the one main surface 13 of the substrate 11, a plan-view circular radiation electrode 14 is formed concentrically with the main surface 13. The diameter of the radiation electrode 14 is smaller than that of the main surface 13. A ground electrode 16 is formed substantially over the entire surface of the other main surface 15 of the substrate 11. This substrate 11 has, for example, the following dimensions: the dielectric constant e=21, the height in the axial direction, t=6 mm, and the diameter of the main surface, D=28 mm.

On the flat plane 12*a* of the substrate 11, two strip shaped feeding electrodes 17 and 18 are formed so as to extend parallel to each other from the ground electrode 16 side toward the radiation electrode 14. More specifically, the upper end portions of the feeding electrodes 17 and 18 wrap around the main surface 13, and constitute capacitively-coupled end portions 17*a* and 18*a* which extend toward the center of the main surface 13. A predetermined distance is formed between each of these capacitively-coupled end portions 17*a* and 18*a* and the periphery of the radiation electrode 14. On the other hand, the lower end portions of the feeding electrodes 17 and 18 wrap around the main surface 15, and constitute connection terminals 17*b* and 18*b*. The connection terminals 17*b* and 18*b* are electrically isolated from the ground electrode 16 by removing the ground electrode 16 portion around these connection terminals and by exposing a portion of the main surface 15.

Figure 2:
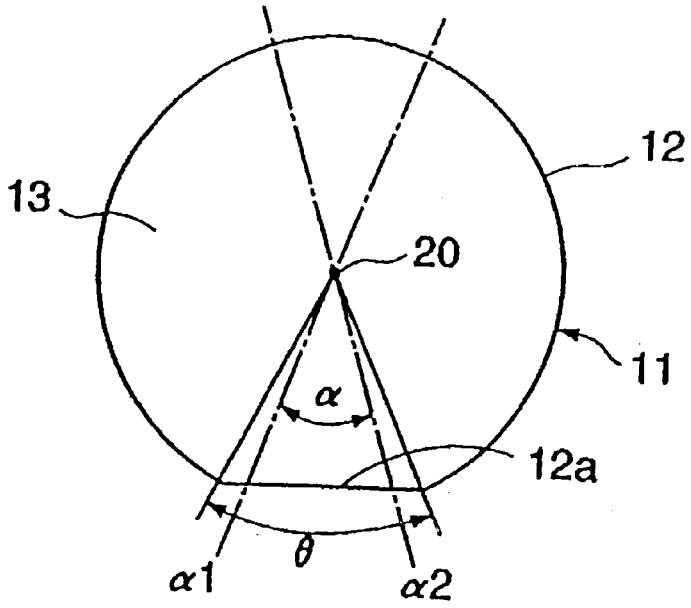
FIG. 2 is a diagram explaining the arrangement of the feeding electrodes shown in FIG. 1.

The feeding electrodes 17 and 18 are disposed as shown in FIG. 2, in order to excite circularly polarized waves in a higher order mode. Specifically, when attempting to excite circularly polarized waves in a higher order mode, the two feeding electrodes 17 and 18 are disposed so as to form an angle $\alpha$ of 90/n° with respect to the center axis 20. For example, in the TM21 mode which is the second order mode, the angle distance $\alpha$ between the feeding electrodes 17 and 18 becomes $\alpha$=45°, and in the third mode (TM31 mode), the angle distance α therebetween becomes α=30°. Also, in the fourth mode (TM41 mode), the angle distance α between the feeding electrodes 17 and 18 becomes α=22.5°.

Herein, in the peripheral side surface 12 of the substrate 11, the range thereof corresponding to an angle ϵ larger than α is formed into the flat plane 12*a* as a flat portion. In order to form the two feeding electrodes 17 and 18 on the flat plane 12*a*, the flat plane 12*a* is formed so as to make angle θ larger than α by 10 to 15°, with respect to the center axis 20. For example, in the TM21 mode, the angle θ made by the flat plane is set to be 55°<θ<60°, and in the TM31 mode, the angle θ made by the flat plane is set to be 40°<θ<45°.

In the above-described features, signal powers which have a mutual phase difference of 90° are supplied to the two feeding electrodes 17 and 18, circularly polarized waves in a higher order mode which are spatially determined by an angle α with respect to the center axis, are excited. For example, in the TM21 mode, circularly polarized waves in the second order mode are excited, and in the TM31 mode, circularly polarized waves in the third order mode are excited.

The circularly polarized wave antenna with the above-described features is mounted onto a circuit board (not shown) of radio terminal equipment. Then, the ground terminal 16 is soldered to the ground pattern of the circuit board, and the connection terminal portions 17*b* and 18*b* are soldered to the input terminals of the circuit board. Herein, when attempting to obtain a receiving antenna exclusive to the above-mentioned DAB system, a radio frequency (RF) circuit in as a receiving circuit and a signal processing circuit are formed on the circuit board.

Figure 3:
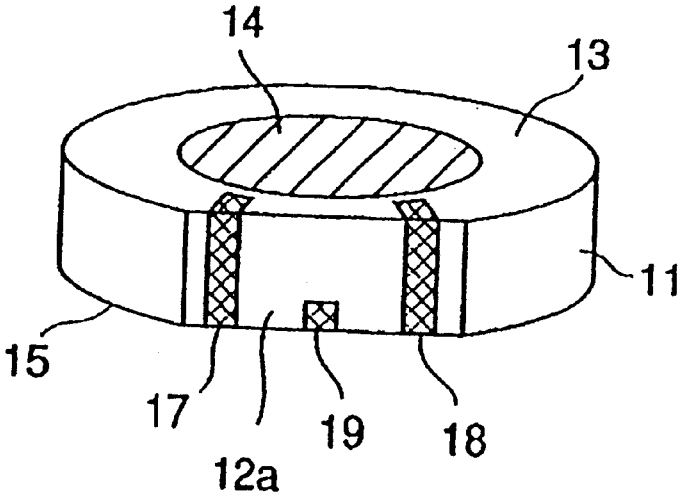
FIG. 3 is a perspective view showing another configuration of a circularly polarized wave antenna in accordance with the present invention.

When fixing the circularly polarized wave antenna more securely on the circuit board, a fixing electrode 19 is provided on the flat plane 12*a* of the substrate 11, as shown in FIG. 3. The fixing electrode 19 is formed making use of the blank portion between the feeding electrodes 17 and 18, and is connected to the ground electrode 16 formed on the other main surface 15 of the substrate 11. These features allow the adhesion strength of the circularly polarized wave antenna with respect to the circuit board to be enhanced.

Figure 4:
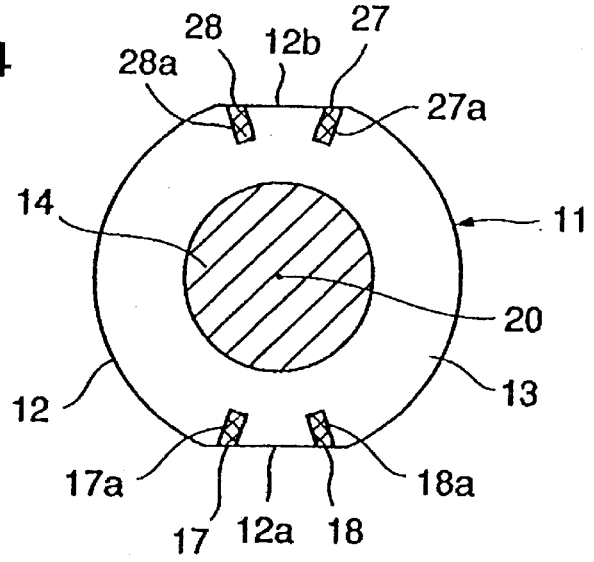
FIG. 4 is a plan view showing still another configuration of a circularly polarized wave antenna in accordance with the present invention.

FIG. 4 shows a circularly polarized wave antenna in accordance with a third embodiment. Here, the same components as those in FIG. 1 are given the same reference numerals, and repeated descriptions of common components will be omitted. On the peripheral side surface 12 of the substrate 11, two flat planes 12*a* and 12*b* parallel to the axial plane are provided. As in the case of FIG. 1, feeding electrodes 17, 18, 27, and 28 are formed. The upper ends of these feeding electrodes 17, 18, 27, and 28 constitute capacitively-coupled end portions 17*a*, 18*a*, 27*a*, and 28*a* extending toward the center of the radiation electrode 14, on the main surface 13. The feeding electrodes 17, 18, 27, and 28, and the capacitively-coupled end portions 17*a*, 18*a*, 27*a*, and 28*a* are formed axially symmetrically with respect to the center axis 20 of the substrate 11.

In this circularly polarized wave antenna, in-phase signal powers are each supplied to the feeding electrodes 17 and 27, and the feeding electrodes 18 and 28, and 90° out-of-phase signal powers are each supplied to the feeding electrodes 17 and 18, and the feeding electrodes 27 and 28. Thereby, an antenna is achieved wherein circularly polarized electromagnetic waves in a higher order mode which are determined by an angle α with respect to the center axis 20, spatially radiated.

Figure 5:
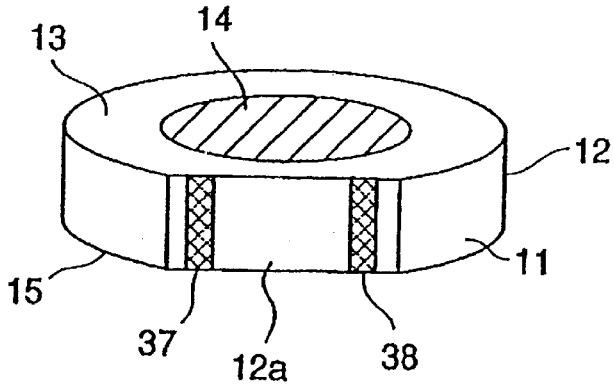
FIG. 5 is a perspective view showing a further configuration of a circularly polarized wave antenna in accordance with the present invention.

FIG. 5 shows a circularly polarized wave antenna in accordance with a fourth embodiment. Here, the same components as those in FIG. 1 are given the same reference numerals, and repeated descriptions of common components will be omitted. In the above-described embodiments, description has been made of the cases where the feeding electrodes 17 and 18 (or the feeding electrodes 17, 18, 27, and 28) include the capacitively-coupled end portions 17*a* and 18*a* (or the capacitively-coupled end portions 17*a*, 18*a*, 27*a*, and 28*a*) formed on the one main surface 13 of the substrate 11, but this embodiment is characterized in that the feeding electrodes thereof are formed as the feeding electrodes 37 and 38 without capacitively-coupled end portions formed on the one main surface 13.

The feeding electrodes 37 and 38 are formed on the flat plane 12*a* of the substrate 11 so as to have a length with the same dimension as that of the height of the substrate 11. Since the radiation electrode 14 and the feeding electrodes 37 and 38 are configured to be capacitively-coupled to each other, the distance between the radiation electrode 14 and each of the feeding electrodes 37 and 38 can be determined by the required coupling amount thereof with respect to the radiation electrode 14. In design of a circularly polarized wave antenna, the length of the feeding electrodes 37 and 38 may be made to have a dimension smaller than that of the height of the substrate 11.

Next, a manufacturing method for a circularly polarized wave antenna will be described. In the circularly polarized wave antenna with the above-described features, the feeding electrodes 17 and 18 are typically formed utilizing the thick-film screen printing technique using a screen pattern. In this case, when the peripheral side surface 12 of the substrate 11 comprises a circumferential surface alone, the printed surface has a given curvature, so that the distance between a mask and the printed surface does not become uniform when printing the feeding electrodes 17 and 18. As a result, the feeding electrodes 17 and 18 are inevitably printed one by one.

Figure 6:
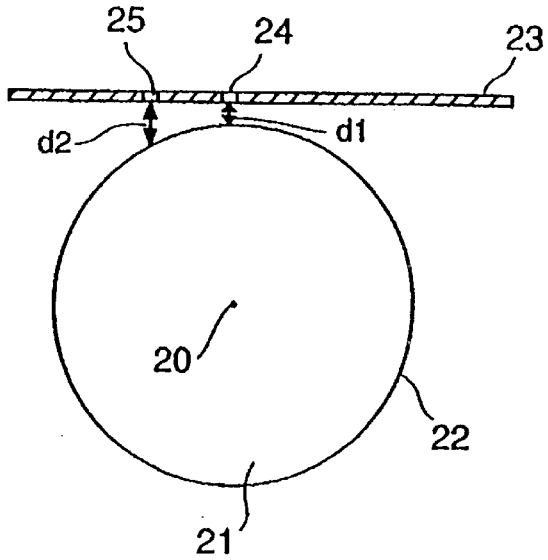
FIG. 6 is a schematic diagram explaining a problem in the manufacturing of a circularly polarized wave antenna in accordance with the present invention.

For example, as shown in FIG. 6, when the side-view peripheral side surface 22 of the cylindrical substrate 21 is a perfect circle around the center axis 20, the distances dl and d2 between the respective electrode patterns 24 and 25 which has been formed on a screen pattern 23 and the peripheral side surface 22 are not uniform since the screen pattern 23 is flat, so that the distance d2 between the electrode pattern 25 and the peripheral side surface becomes larger than the distance between the electrode pattern 24 and the peripheral side surface.

As a result, only the electrode using the electrode pattern 24 is well printed, and the electrode using the electrode pattern 25 is defectively printed in a manner such that the electrode width is expanded. In order to obtain well printed electrodes, therefore, it becomes necessary to repeat printing processes the same number of times as the number of electrodes. This results in an increase in manufacturing time.

Even if the printing is performed for every electrode pattern, the thicknesses of electrodes do not become uniform due to the curvature of the peripheral side surface 22, so that variations in the capacitances between the feeding electrodes and the radiation electrode occur from one circularly polarized wave antenna to another circularly polarized wave antenna. This causes product-to-product variation.

Accordingly, in the present invention, a circularly polarized wave antenna is manufactured using the following manufacturing method. Here, in FIGS. 7 to 9, the same components as those in FIG. 1 are given the same reference numerals, and repeated descriptions of common components will be omitted.

Figure 7:
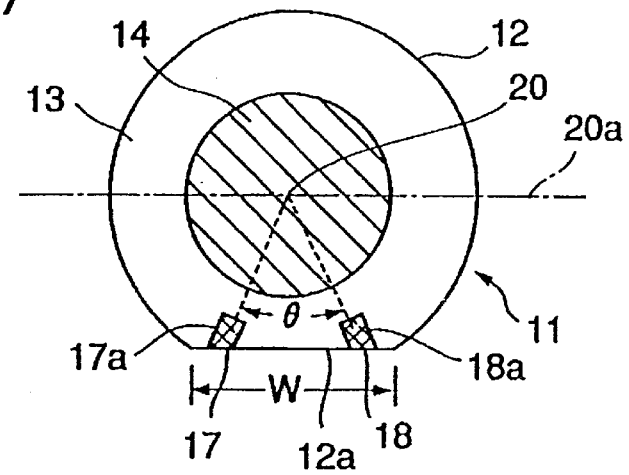
FIG. 7 is a plan view showing a circularly polarized wave antenna for explaining the manufacturing method for a circularly polarized wave antenna in accordance with the present invention.

In FIG. 7, the cylindrical substrate 11 is provided with a flat plane 12*a* parallel to the axial plane 20*a* passing through the center axis 20. With regard to the width w of the flat plane 12*a*, the flat plane 12*a* is formed so as to be slightly wider than the width thereof when the feeding electrodes 17 and 18, disposed in order to obtain a desired higher order mode, form an angle θ. Specifically, in the TM21 mode, the peripheral side surface 12 is flattened up to angular positions forming an angle slightly larger than 45° with respect to the center axis 20. Herein, the main surface 13 having a substantially circular shape os a perfect circle shape of which a portion has been cut away. However, since the portion cut away is slight, the main surface 13 still retains substantially the characteristic of a perfect circle.

On the main surface 13 of the substrate 11, a radiation electrode 14 having a diameter smaller than that of the main surface 13, and capacitively-coupled end portions 17*a* and 18*a* are formed at one time. Specifically, when a screen pattern having a radiation electrode pattern and capacitively-coupled end portion patterns are placed on the main surface 13 of the substrate 11, and then a conductive paste is applied thereon, a radiation electrode 14 and capacitively-coupled end portions 17*a* and 18*a*, each having a thickness of about 10 mm, are formed.

Figure 8:
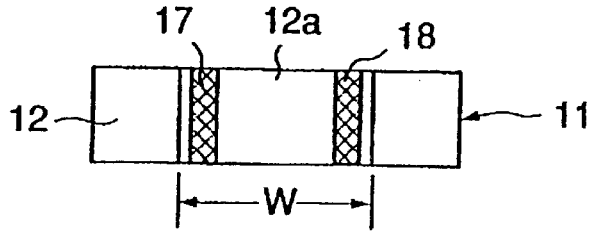
FIG. 8 is a side view showing a circularly polarized wave antenna for explaining the manufacturing method for a circularly polarized wave antenna in accordance with the present invention.

Also, as shown in FIG. 8, two strip shaped feeding electrodes 17 and 18 are formed on the flat plane 12*a* of the substrate 11, at one time. The flat plane 12*a* has a width w. Since the two feeding electrodes 17 and 18 are formed at the angular positions corresponding to a desired higher order mode, the feeding electrodes are disposed with a space interposed therebetween in the width direction of the flat plane 12*a*. In this case also, since the flat plane 12*a* has a uniform distance between the flat plane 12*a* and the screen pattern, at any position, the two feeding electrodes 17 and 18 are printed at one time using the two feeding electrode patterns formed on the screen pattern. Even when attempting to print the second electrode shown in FIG. 3, the second electrode is collectively printed together with the two feeding electrodes 17 and 18.

Figure 9:
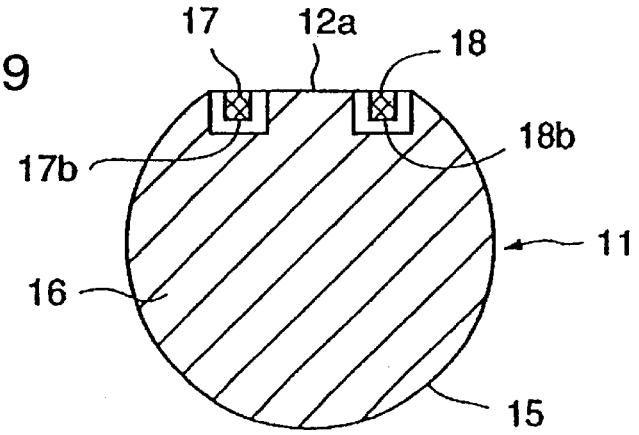
FIG. 9 is a bottom view showing a circularly polarized wave antenna for explaining the manufacturing method for a circularly polarized wave antenna in accordance with the present invention.
Figure 10:
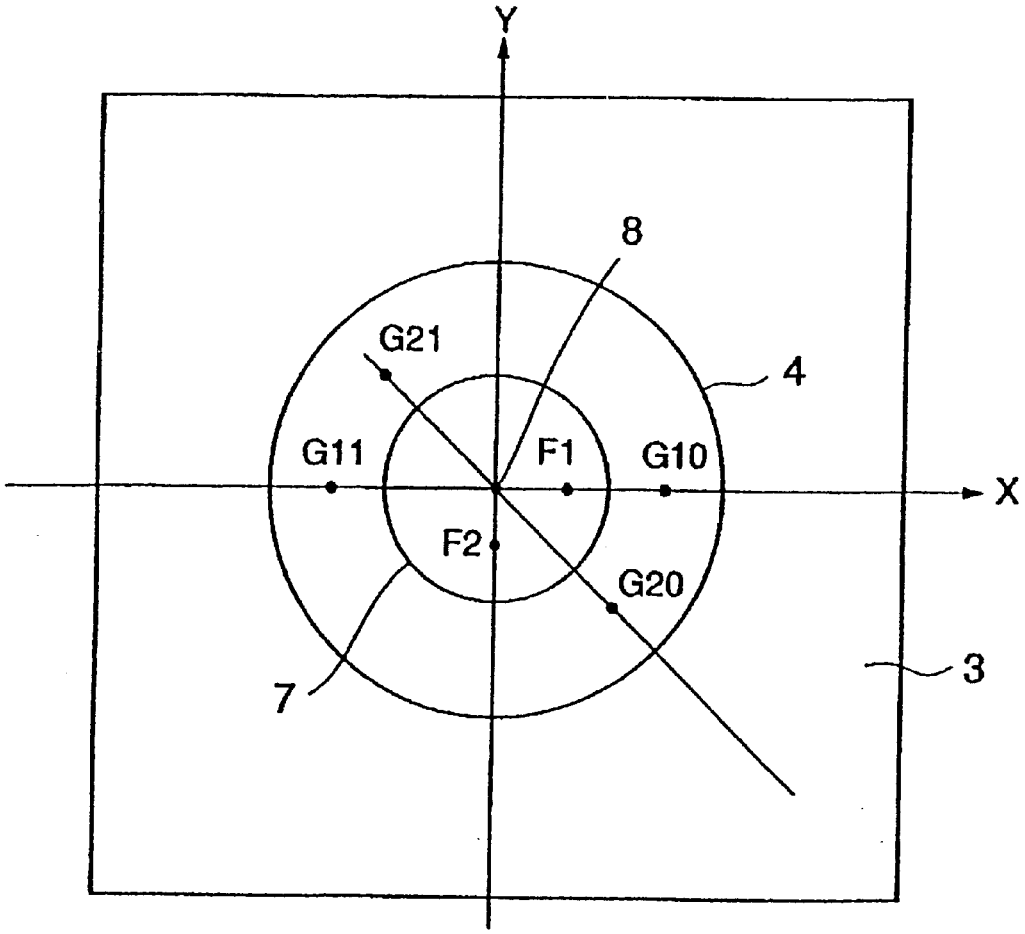
FIG. 10 PRIOR ART
FIG. 10 is a plan view showing a conventional circularly polarized wave microstrip antenna.
Figure 11:
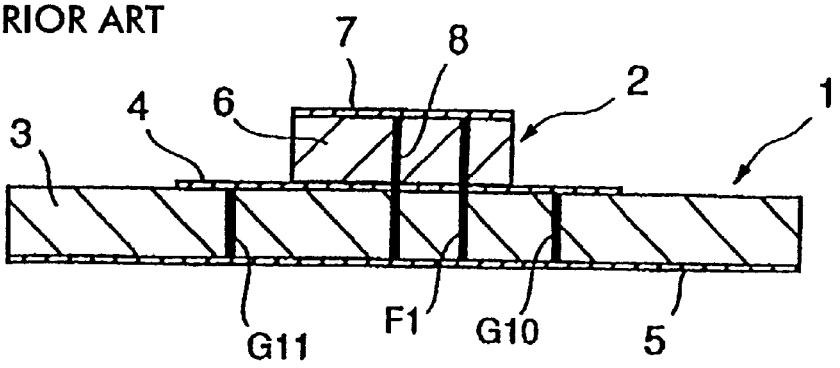
FIG. 11 PRIOR ART
FIG. 11 is a sectional view taken along the X-axis of FIG. 10.

The same is true for the formation of the electrodes on the ground electrode 16 side in the circularly polarized wave antenna. As shown in FIG. 9, on the other main surface 15, a ground electrode is formed over the entire surface thereof except for the surrounding of the connection terminal portions 17*b* and 18*b*, and the connection terminal portions 17*b* and 18*b* are also printed simultaneously with the ground electrode 16. Herein, the connection terminal portions 17*b* and 18*b* are formed so as to extend perpendicularly to the flat plane 12*a*.

In the above-described manufacturing method for a circularly polarized wave antenna, when forming thick-film electrodes on the substantially cylindrical substrate 11, the printing of all electrodes is completed by repeating three printing processes, that is, the printing process (which comprises of the processes of printing and drying) for the electrodes 14, 17*a*, and 18*a* on the one main surface 13, the printing process for the electrodes 17 and 18 on the flat plane 12*a*, and the printing process for the electrodes 16, 17*b*, and 18*b* on the other main surface 15. Since the printing of all electrodes is performed with respect to planes, homogeneous thick-film electrodes can be achieved. In the above-described printing process, the upper and lower ends of the feeding electrodes 17 and 18 are connected to the capacitively-coupled end portions 17*a* and 18*a*, and the connection terminal portions 17*b* and 18*b*, respectively.

As is evident from the foregoing, in accordance with the circularly polarized wave antenna of the present invention, since the distance between the periphery of the radiation electrode and that of the main surface of the substrate is uniform except for the flat portion, the frequency characteristic of the linearly polarized waves by the two feeding electrodes can be equalized, thereby improving the axial ratio-frequency characteristic in the circularly polarized wave excitation in a higher order mode.

Since the two feeding electrodes are formed on the outer surface of the substrate instead of being formed so as to pass through the substrate as before, the length and/or width of the feeding electrodes can be adjusted by, for example, trimming using laser breams, even after the feeding electrodes have been formed on the substrate. This facilitates the matching of the resonant frequencies in the resonant currents in a higher order mode excited by the radiation electrode, and allows a circularly polarized wave in a higher order mode to be easily achieved.

Furthermore, in accordance with the circularly polarized wave antenna of the present invention, since the flat plane of the flat portion is utilized even when forming an electrode other than the feeding electrodes, the electrode can be well formed. For example, in the case where a fixing electrode is provided, the adhesion strength can be enhanced when mounting the circularly polarized wave antenna onto a circuit board.

In accordance with the manufacturing method for a circularly polarized wave antenna of the present invention, since electrodes such as the feeding electrodes are formed on the flat portion of the substrate, the electrode patterns can be formed in one printing process using, for example, the thick-film printing technique, thereby reducing the time period during the printing process for the electrode formation. This allows the manufacturing cost to be reduced, and enables the thickness of electrodes to become uniform.

Moreover, in accordance with the manufacturing method for a circularly polarized wave antenna of the present invention, since the area of the flat plane of the substrate becomes the widest, the forming of another electrode in conjunction with the radiation electrode is facilitated.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications that fall within the true spirit and scope of the invention.

What is claimed is:

1. A circularly polarized wave antenna, comprising:

a substantially cylindrical substrate comprising a dielectric body;

a radiation electrode having a circular shape in a plan view, said radiation electrode being formed on a first main surface of said substrate;

a ground electrode formed on a second main surface of said substrate;

a flat portion disposed on a peripheral side surface of said substrate between said first and second main surfaces; and at least two strip shaped feeding electrodes which are formed on said flat portion so as to extend from said first main surface to said second main surface.

2. The circularly polarized wave antenna of claim 1, wherein said flat portion is provided with a second electrode in conjunction with said feeding electrodes.

3. The circularly polarized wave antenna of claim 2, wherein the second electrode is provided between said two feeding electrodes, and the second electrode is used for fixing the antenna onto a circuit board.

4. The circularly polarized wave antenna of claim 1, further comprising a second flat portion disposed on the peripheral side surface of the substrate, said second flat portion having at least two strip shaped feeding electrodes formed on said flat portion so as to extend from said first main surface to said second main surface.

5. The circularly polarized wave antenna of claim 1, wherein said two feeding electrodes are coupled to electrode end portions extending onto said first main surface and capacitively coupled to said radiation electrode.

6. The circularly polarized wave antenna of claim 1, wherein said two feeding electrodes are coupled to electrode end portions extending onto said second main surface, insulated from said ground electrode.

7. The circularly polarized wave antenna of claim 1, wherein the feeding electrodes are spaced from each other so as to excite circularly polarized waves in a high order mode.

8. The circularly polarized wave antenna of claim 7, wherein the feeding electrodes are spaced at an angle $\alpha$ of 90/n°, where n is a number related to the order mode.

9. The circularly polarized wave antenna of claim 8, wherein the flat portion has a width defined by an angle $\theta$ greater than said angle $\alpha$.

10. A method for manufacturing a circularly polarized wave antenna, said method comprising the steps of:

forming a circular radiation electrode having a circular shape in a plan view on a first main surface of a cylindrical substrate, and forming a ground electrode on a second main surface of the substrate;

forming a flat portion on a peripheral side surface of said substrate; and collectively forming at least two feeding electrodes on said flat portion so as to extend from said first main surface to said second main surface.

11. The method of claim 10, further comprising forming said flat portion on said peripheral side surface in a plane parallel to a center axis of said substrate.

12. The method of claim 10, further comprising providing said flat portion with a second electrode in conjunction with said feeding electrodes.

13. The method of claim 12, further comprising providing said second electrod between said two feeding electrodes, and using the second electrode is used for fixing the antenna onto a circuit board.

14. The method of claim 10, further comprising providing a second flat portion on the peripheral side surface of the substrate and forming on said second flat portion at least two strip shaped feeding electrodes extending from said first main surface to said second main surface.

15. The method of claim 10, further comprising coupling said two feeding electrodes to electrode end portions extending onto said first main surface and capacitively coupled to said radiation electrode.

16. The method of claim 10, further comprising coupling said two feeding electrodes to electrode end portions extending onto said second main surface, insulated from said ground electrode.

17. The method of claim 10, further comprising providing the feeding electrodes spaced from each other so as to excite circular polarized waves in a high order mode.

18. The method of claim 17, further comprising providing the feeding electrode spaced at an angle $\alpha$ of 90/n°, where n is a number related to the order mode.

19. The method of claim 18, wherein the flat portion has a width defined by an angle $\theta$ greater than said angle $\alpha$.

* * * * *